US009049951B2

(12) United States Patent
Keys et al.

(10) Patent No.: US 9,049,951 B2
(45) Date of Patent: Jun. 9, 2015

(54) MULTI-FUNCTIONAL ACCESSORY

(75) Inventors: James R. Keys, Oakland, CA (US); Madeline Kwiecien, Pleasanton, CA (US); Brett D. McIntire, Pleasanton, CA (US); Daniel Nunez, Fremont, CA (US)

(73) Assignee: Brita LP, Oakland, CA (US)

( * ) Notice: Subject to any disclaimer, the term of this patent is extended or adjusted under 35 U.S.C. 154(b) by 137 days.

(21) Appl. No.: 13/599,396

(22) Filed: Aug. 30, 2012

(65) Prior Publication Data

US 2014/0061151 A1 Mar. 6, 2014

(51) Int. Cl.
*A47G 23/03* (2006.01)
*A47G 19/12* (2006.01)

(52) U.S. Cl.
CPC ..... *A47G 23/0316* (2013.01); *A47G 19/12* (2013.01)

(58) Field of Classification Search
CPC ..... B65D 25/24; A47G 19/20; Y10S 220/903
USPC ..... 220/737, 739, 740, 743
See application file for complete search history.

(56) References Cited

U.S. PATENT DOCUMENTS

| | | | | | |
|---|---|---|---|---|---|
| 1,924,011 | A * | 8/1933 | Willmott | 222/186 |
| 2,578,646 | A * | 12/1951 | August | 248/145.6 |
| 2,932,119 | A * | 4/1960 | Borah | 248/346.11 |
| 2,979,225 | A * | 4/1961 | Noffsinger | 220/742 |
| 3,203,598 | A * | 8/1965 | Alford | 222/183 |
| 3,941,237 | A * | 3/1976 | MacGregor, Jr. | 198/867.13 |
| 4,255,457 | A * | 3/1981 | Collias | 426/407 |
| 4,852,843 | A * | 8/1989 | Chandler | 248/311.2 |
| 5,176,280 | A * | 1/1993 | Robbins, III | 220/737 |
| 5,222,534 | A * | 6/1993 | Wilkinson, Jr. | 141/88 |
| 5,292,140 | A * | 3/1994 | Laing | 280/47.33 |
| 5,415,305 | A * | 5/1995 | Drake-Tipton et al. | 215/392 |
| 5,772,069 | A * | 6/1998 | Price | 220/737 |
| 5,848,722 | A * | 12/1998 | Hanes | 220/741 |
| 5,860,559 | A * | 1/1999 | Wang | 220/737 |
| 6,026,982 | A * | 2/2000 | Caruthers | 220/737 |
| 6,059,138 | A * | 5/2000 | Labruyere | 220/574 |
| 6,460,722 | B2 * | 10/2002 | Lee | 220/592.16 |
| 6,543,637 | B1 * | 4/2003 | Osborn | 220/737 |
| 6,745,987 | B2 * | 6/2004 | Rousselet et al. | 248/363 |
| 7,614,516 | B2 * | 11/2009 | Beggins | 215/386 |
| 7,712,625 | B2 * | 5/2010 | Alger | 220/737 |
| 7,909,202 | B1 * | 3/2011 | Gordon | 220/742 |
| 8,011,166 | B2 * | 9/2011 | Sheets et al. | 53/127 |
| 8,028,850 | B2 * | 10/2011 | Zimmerman | 220/23.89 |
| 8,397,941 | B1 * | 3/2013 | Stocker | 220/737 |
| 8,534,491 | B1 * | 9/2013 | Stocker | 220/737 |
| 8,579,149 | B2 * | 11/2013 | Henke et al. | 220/737 |
| 2001/0040380 | A1 * | 11/2001 | Forjone | 294/31.2 |
| 2008/0190948 | A1 * | 8/2008 | Sayasithsena | 220/737 |
| 2011/0315749 | A1 | 12/2011 | Brittain | |
| 2012/0043243 | A1 | 2/2012 | Selina | |
| 2012/0118897 | A1 * | 5/2012 | Davis | 220/592.01 |

FOREIGN PATENT DOCUMENTS

| | | |
|---|---|---|
| CA | 2744288 | 12/2011 |
| CA | 2726372 | 2/2012 |

* cited by examiner

*Primary Examiner* — Fenn Mathew
*Assistant Examiner* — Christopher McKinley
(74) *Attorney, Agent, or Firm* — Stacy H. Combs; Thomas C. Feix

(57) ABSTRACT

In an embodiment, a multi-functional accessory serves as a platform for implementing modifications to a product in a time-saving and less costly manner, whereas the modifications would otherwise be made to the product itself. In an embodiment, the product is inserted into the multi-functional accessory. In an embodiment, the multi-functional accessory may be utilized in applications with exposure to a liquid or moisture and in dry applications with no or minimal exposure to a liquid or moisture.

20 Claims, 6 Drawing Sheets

MULTI-FUNCTIONAL ACCESSORY

FIELD

Embodiments relate to accessories. More specifically, embodiments relate to multi-functional accessories.

BACKGROUND

Products are being manufactured on a large-scale for home and/or business applications. Various manufacturing techniques are utilized to ensure the Nth manufactured product is the same in numerous characteristics as the Nth+50 manufactured product.

However, these large-scale manufacturing techniques generally require a modification (e.g., to address deficiencies, to incorporate new features, etc.) to the product design to undergo a time-consuming and costly design and testing process. By the time the modification is implemented, other desirable modifications have been identified. Typically, it is uneconomical to implement every desired modification to the product design. As a result, a modification that is not implemented may be the modification that would have improved the product the most from the perspective of the purchaser and would have lead to greater sales of the product.

SUMMARY

In an embodiment, a multi-functional accessory serves as a platform for implementing modifications to a product (e.g., a pitcher for water) in a time-saving and less costly manner, whereas the modifications would otherwise be made to the product itself. In an embodiment, the product is inserted into the multi-functional accessory. In an embodiment, the multi-functional accessory may be utilized in applications with exposure to a liquid or moisture and in dry applications with no or minimal exposure to a liquid or moisture.

In accordance with an embodiment, the multi-functional accessory provides a passage for water to drain and to evaporate. Consequently, mold, mildew, or other microorganism growth caused by the pooling and collecting water is inhibited.

The multi-functional accessory may function as a protective sleeve for the pitcher, in accordance with an embodiment. The multi-functional accessory may protect or guard against scratching and scuffing of the external surface of the pitcher.

Furthermore, in an embodiment, the multi-functional accessory functions as a coaster to maintain a surface (e.g., a table surface) clean and free of stains.

BRIEF DESCRIPTION OF THE DRAWINGS

The accompanying drawings, which are incorporated in and form a part of this specification, illustrate embodiments, together with the description, serve to explain the principles of the disclosure.

DETAILED DESCRIPTION

Reference will now be made in detail to embodiments, examples of which are illustrated in the accompanying drawings. While the disclosure will be described in conjunction with these embodiments, it should be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description, numerous specific details are set forth in order to provide a thorough understanding. However, it will be recognized by one of ordinary skill in the art that embodiments may be practiced without these specific details.

As discussed above, it is generally uneconomical to implement every desired modification to a product design. In an embodiment, a multi-functional accessory serves as a platform for implementing modifications to a product in a time-saving and less costly manner, whereas the modifications would otherwise be made to the product itself. In an embodiment, the product is inserted into the multi-functional accessory. In an embodiment, the multi-functional accessory may be utilized in applications with exposure to a liquid or moisture and in dry applications with no or minimal exposure to a liquid or moisture.

Although the description will focus on a multi-functional accessory in combination with a pitcher for water or any other liquid, it should be understood that the multi-functional accessory may be used in combination with other products for home and/or business. Embodiments are not limited to multi-functional accessories for pitchers.

Figure 1:
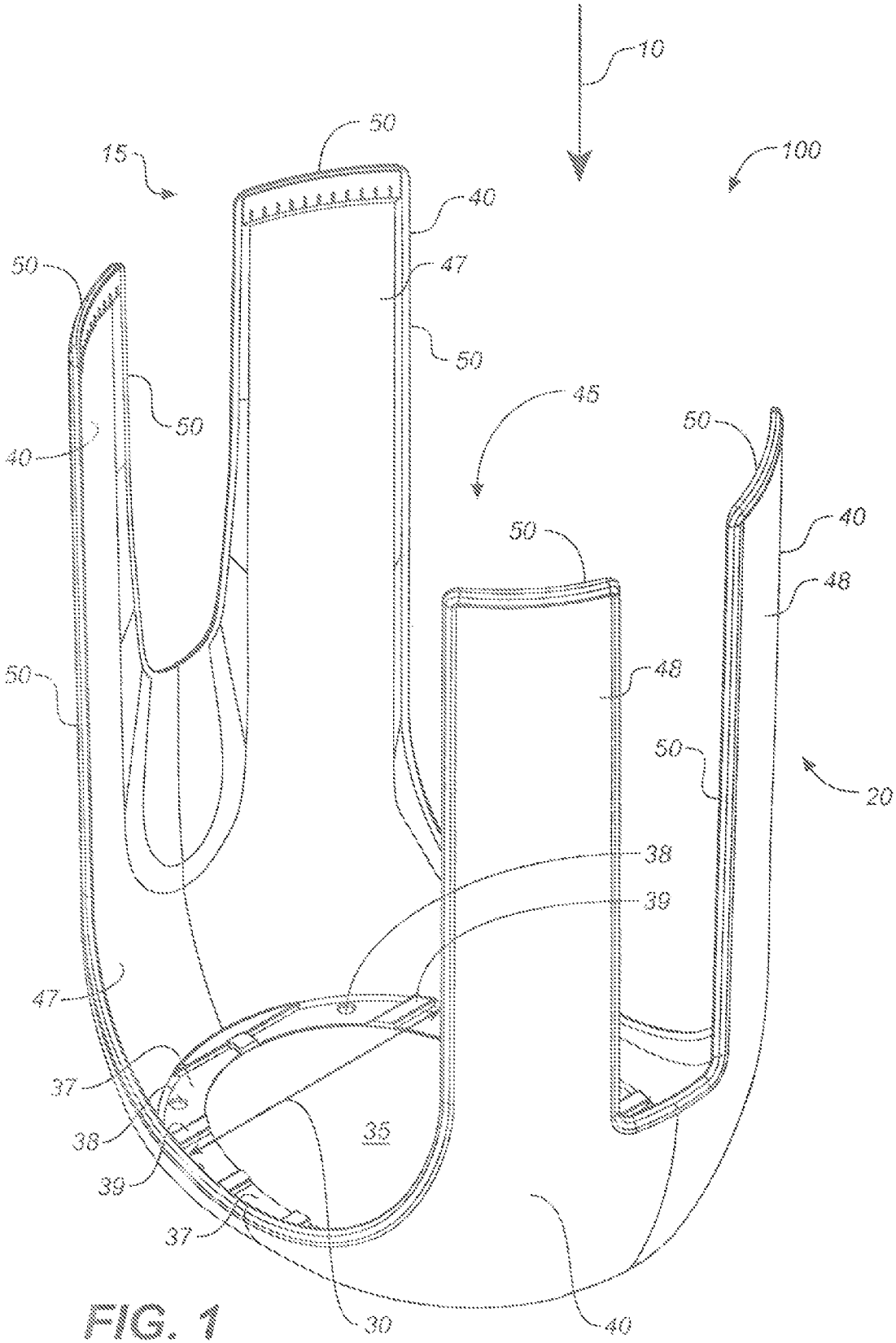
FIG. 1 depicts a perspective view of a multi-functional accessory 100 in accordance with an embodiment.
Figure 2:
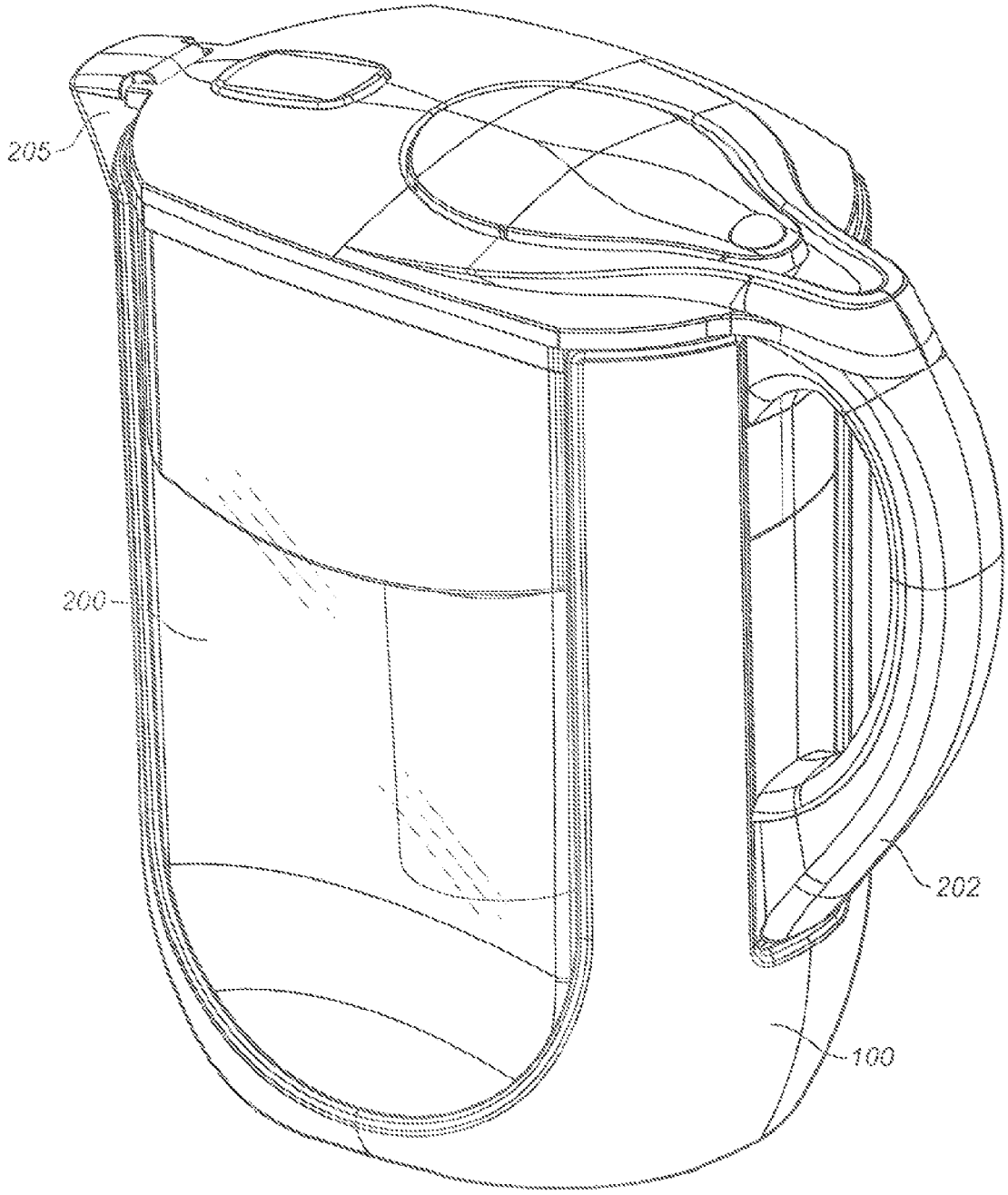
FIG. 2 shows a pitcher 200 inserted into the multi-functional accessory 100 of FIG. 1 in accordance with an embodiment.

FIG. 1 depicts a perspective view of a multi-functional accessory 100 in accordance with an embodiment. FIG. 2 shows a pitcher 200 inserted into the multi-functional accessory 100 of FIG. 1 in accordance with an embodiment. As depicted in FIG. 2, the pitcher 200 includes a spout 205 and a handle 202 in accordance with an embodiment.

Referring to FIG. 1, the multi-functional accessory 100 has a front or spout-receiving portion 15 and a back or handle-receiving portion 20. The arrow 10 provides a direction in which the pitcher 200 (shown in FIG. 2) is inserted into the multi-functional accessory 100, whereas the pitcher's spout 205 (shown in FIG. 2) is inserted into the spout-receiving portion 15 while the pitcher's handle 202 (shown in FIG. 2) is inserted into the handle-receiving portion 20.

Further, the multi-functional accessory 100 includes a base 30 and a wall 40 that defines a cavity 45. The cavity 45 includes an internal surface 47 and an external surface 48. Additionally, the cavity 45 has a lip 50.

The lip 50 is located on the internal surface 47 of the cavity 45. Moreover, the lip 50 extends along the perimeter of the internal surface 47 and extends along an edge of the internal surface 47.

Figure 4:
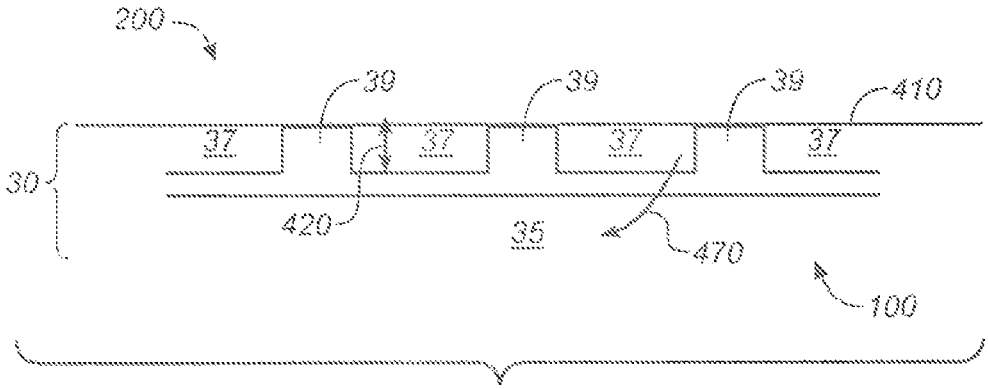
FIG. 4 illustrates in greater detail a side view of the pitcher 200 with the multi-functional accessory 100 of FIG. 2, showing a bottom surface 410 of pitcher 200 with respect to the base 30 of multi-functional accessory 100 in accordance with an embodiment.

The base 30 includes an opening 35. Additionally, the base 30 has a plurality of channels 37 adjacent to the opening 35 and a plurality of surface projections 39 adjacent to the opening 35. In an embodiment, the base 30 further has a plurality of holes 38. (Also see FIGS. 9 and 10). The holes 38 are spaced apart. Moreover, the holes 38 are located in the channels 37. In an embodiment, the channels 37 are downward sloped or slanted towards the opening 35. As will be discussed below, the downward slope or slant of the channels 37 promotes and aids water to exit through the opening 35 in the base 30 or through the holes 38 in the channels 37 instead of pooling and collecting in the base 30. In an embodiment, the surface projections 39 have a thickness that is greater than a thickness of the channels 37. FIG. 4 depicts in greater detail a side view of the channels 37 and the surface projections 39. The downward slope or slant of the channels 37 is not shown in the side view of FIG. 4. In an embodiment, the base 30 functions as a stop for the pitcher 200 (FIG. 2) being inserted into the cavity 45 of the multi-functional accessory 100. In an embodiment, the pitcher 200 (FIG. 2) resting inside the cavity 45 of the multi-functional accessory 100 contacts the surface projections 39 of the base 30 and the lip 50 located on the internal surface 47 of the cavity 45. As will be discussed below, the holes 38 (not shown in the side view of FIG. 4) in the channels 37 further promote and aid draining of water out of the base 30 instead of pooling and collecting in the base 30.

In an embodiment, the multi-functional accessory 100 is made from a plastic such as styrene acrylonitrile (SAN). The multi-functional accessory 100 is rigid and sturdy. It should be understood the multi-functional accessory 100 may be made from other materials.

Continuing with FIG. 1, the multi-functional accessory 100 may be a single piece formed by injection molding, in accordance with an embodiment. Alternatively, the multi-functional accessory 100 may have a multiple piece design. For example, two halves may be connected or attached to form the multi-functional accessory 100.

The multi-functional accessory 100 may be secured to the pitcher 200 (FIG. 2) by using any of several techniques. In an embodiment, the multi-functional accessory 100 is irremovably attached to the pitcher 200 (FIG. 2). For example, the multi-functional accessory 100 may be ultrasonically welded to the pitcher 200 (FIG. 2) along an area of the pitcher 200 (FIG. 2) where the lip 50 contacts the pitcher 200 since, in an embodiment, the pitcher 200 (FIG. 2) resting inside the cavity 45 of the multi-functional accessory 100 contacts the surface projections 39 of the base 30 and the lip 50 located on the internal surface 47 of the cavity 45. The lip 50 extends along the perimeter of the internal surface 47 of the cavity 45 and extends along an edge of the internal surface 47 of the cavity 45.

Alternatively, the multi-functional accessory 100 is removably attached to the pitcher 200 (FIG. 2) in a snap fit manner or in any other type of removable manner.

Embodiments of the multi-functional accessory 100 are not limited to the shape depicted in FIG. 1. Factors influencing the shape of the multi-functional accessory 100 include shape of the pitcher 200 (FIG. 2), percentage of the pitcher 200 (FIG. 2) covered by the multi-functional accessory 100, and external features of the pitcher 200 (FIG. 2). Pitchers may have an oval shape, a circular shape, a cylindrical shape, a rectangular shape, or other type of shape. Accordingly, the multi-functional accessory 100 may be shaped or contoured to accommodate the shape of the pitcher. Also, in the embodiment shown in FIG. 1, the multi-functional accessory 100 does not cover or enclose the entire external surface of the pitcher 200 (FIG. 2). However, the multi-functional accessory 100 may be shaped or contoured to cover or enclose either more or less than the external surface of the pitcher 200 (FIG. 2) covered or enclosed by the multi-functional accessory 100 illustrated in FIG. 1. Further, external features of the pitcher 200 (FIG. 2) such as spout 205 and handle 202 influence the shape and location of slots or recesses in the wall 40 corresponding to the spout-receiving portion 15 and the handle-receiving portion 20 of the multi-functional accessory 100.

As mentioned above, the multi-functional accessory 100 may be utilized in applications with exposure to a liquid or moisture and in dry applications with no or minimal exposure to a liquid or moisture. In FIG. 2, the pitcher 200 for water or other liquid is inserted into the multi-functional accessory 100, illustrating an example of an application with exposure to a liquid or moisture.

Although the description will focus on a multi-functional accessory exposed to water and will focus on a pitcher for water, it should be understood that the multi-functional accessory may be exposed to other types of liquids and that the pitcher may be a pitcher for another type of liquid. Embodiments are not limited to multi-functional accessories exposed to water and are not limited to pitchers for water.

Figure 3:
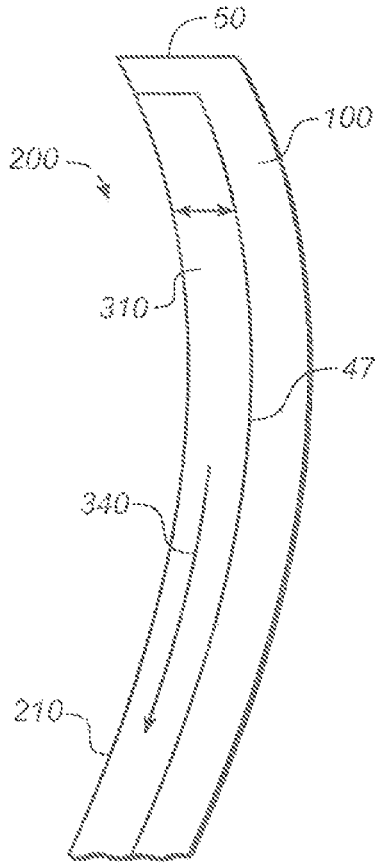
FIG. 3 illustrates in greater detail the pitcher 200 with the multi-functional accessory 100 of FIG. 2, showing an external surface 210 of pitcher 200 with respect to the multi-functional accessory 100 in accordance with an embodiment.

FIG. 3 shows in greater detail the pitcher 200 with the multi-functional accessory 100 of FIG. 2. An external surface 210 of pitcher 200 with respect to the multi-functional accessory 100 is illustrated in accordance with an embodiment. As depicted in FIG. 3, the lip 50 of the multi-functional accessory 100 creates a separation or gap 310 between the external surface 210 of pitcher 200 and the internal surface 47 of the multi-functional accessory 100. In an embodiment, the gap 310 is a fixed distance for the pitcher 200 resting inside the cavity 45 (FIG. 1) of the multi-functional accessory 100.

In an embodiment, the gap 310 is at least 1 millimeter (mm). It should be understood that the size of the gap 310 may be influenced by factors such as the materials from which the multi-functional accessory 100 and the pitcher 200 are manufactured and the type of liquid to which the multi-functional accessory 100 is exposed and enters the gap 310.

FIG. 4 shows in greater detail a side view of the pitcher 200 with the multi-functional accessory 100 of FIG. 2. A bottom surface 410 of pitcher 200 with respect to the base 30 of multi-functional accessory 100 is illustrated in accordance with an embodiment. As depicted in the side view of FIG. 4, the surface projections 39 of the multi-functional accessory 100 create a separation 420 between the bottom surface 410 of pitcher 200 and the channels 37 of the multi-functional accessory 100. In an embodiment, the separation 420 is a fixed height for the pitcher 200 resting inside the cavity 45 (FIG. 1) of the multi-functional accessory 100. As will be discussed below, the downward slope or slant (not shown in FIG. 4) of the channels 37 promotes and aids water to exit through the opening 35 in the base 30 or through the holes 38 in the channels 37 instead of pooling and collecting in the base 30. Also, as will be discussed below, the holes 38 (not shown in the side view of FIG. 4) in the channels 37 further promote and aid draining of water out of the base 30 instead of pooling and collecting in the base 30.

Referring again to FIG. 2 where the pitcher 200 is inserted into the multi-functional accessory 100, the multi-functional accessory 100 may be exposed to water due to numerous circumstances. For example, water held by the pitcher 200 may produce condensation on the external surface 210 (FIG. 3) of pitcher 200. The condensation may contact the multi-functional accessory 100. As another example, during cleaning, the pitcher 200 and multi-functional accessory 100 may be submerged in water or washed with water, allowing water to enter the gap 310 (FIG. 3).

In accordance with an embodiment, the multi-functional accessory 100 provides a passage for water to drain and to evaporate. As depicted in FIG. 3, the gap 310 is sufficiently wide to cause water to drain and evaporate in the direction of arrow 340 to keep the gap 310 dry instead of pooling and collecting in the gap 310. In an embodiment, the transition from the internal surface 47 of the multi-functional accessory 100 to the base 30 (FIG. 1) is smooth and curved, enhancing and assisting the draining of water. Further, as illustrated in the side view of FIG. 4, at the base 30 (FIG. 1) of the multi-functional accessory 100, the channels 37 direct (in the direction of arrow 470) the water to exit through the opening 35 in the base 30 or through the holes 38 (not shown in the side view of FIG. 4) in the channels 37 instead of pooling and collecting in the base 30. That is, the downward slope or slant (not shown in the side view of FIG. 4) of the channels 37 promotes and aids draining of the water out of the base 30. Moreover, the holes 38 (not shown in the side view of FIG. 4) in the channels 37 further promote and aid draining of the water out of the base 30 instead of pooling and collecting in the base 30.

Consequently, mold, mildew, or other microorganism growth caused by the pooling and collecting water is inhibited. Also, discoloration caused by the pooling and collecting water is resolved. As a result, the multi-functional accessory 100 may be utilized in applications with exposure to water or moisture and in dry applications with no or minimal exposure to water or moisture.

Figure 5:
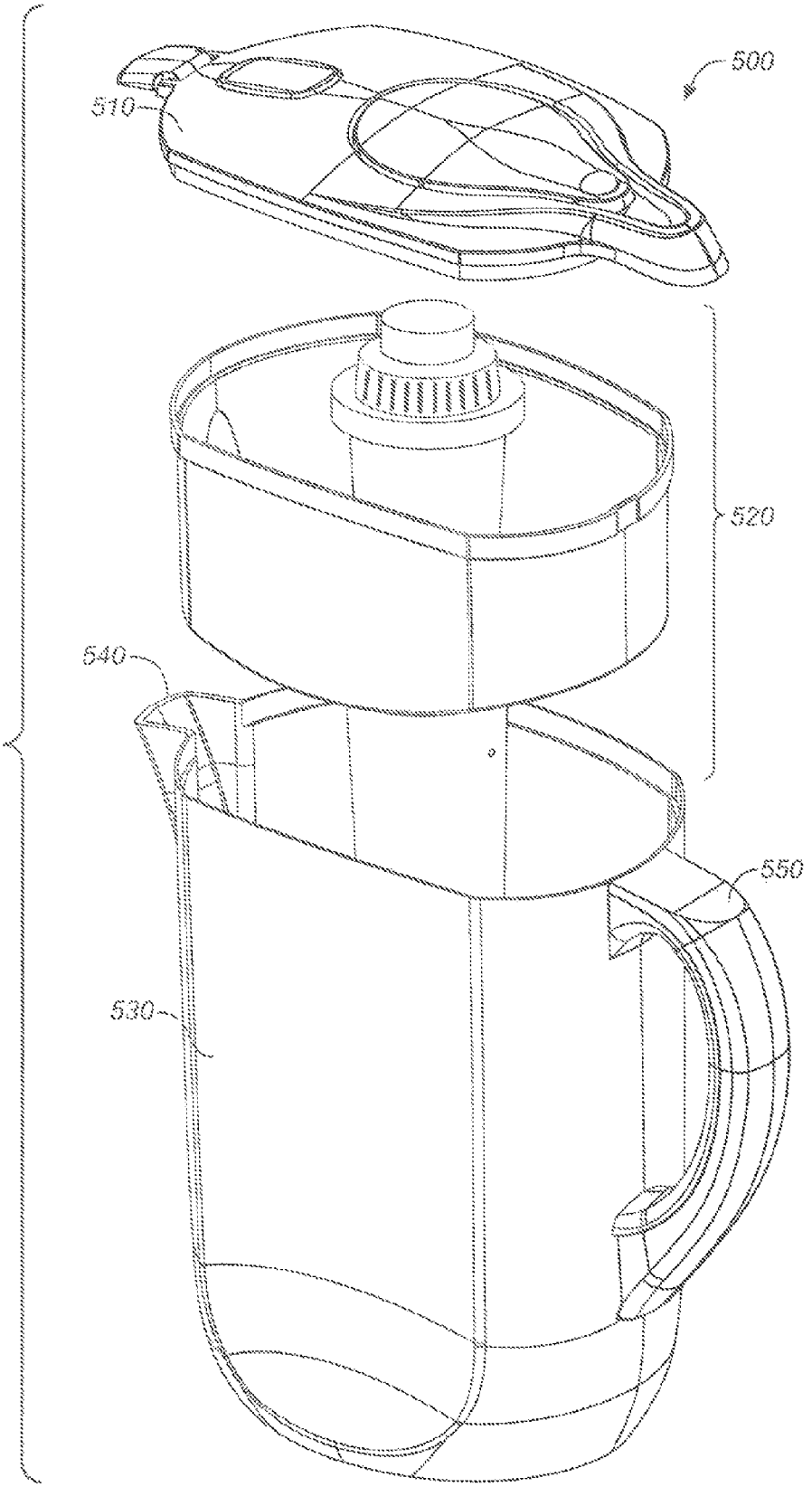
FIG. 5 illustrates an exploded view of a water filtering pitcher 500 in accordance with an embodiment.

In an embodiment, the pitcher 200 may be a water filtering pitcher. FIG. 5 illustrates an exploded view of a water filtering pitcher 500 in accordance with an embodiment. As depicted in FIG. 5, the water filtering pitcher 500 includes a lid 510, a water filtering assembly 520, a reservoir 530, a spout 540, and a handle 550. In an embodiment, the water filtering assembly 520 cleans the water and improves the taste and odor of the water. The water filtering assembly 520 may remove or reduce sediments/contaminants such chlorine, copper, mercury, lead, cadmium, or other substances.

The reservoir 530 is made from a plastic such as styrene acrylonitrile (SAN), in accordance with an embodiment. It should be understood the reservoir 530 may be made from other materials.

Referring again to FIGS. 1 and 2, the multi-functional accessory 100 may function as a protective sleeve for the pitcher 200, in accordance with an embodiment. In an embodiment, the wall 40 protects the pitcher. The multi-functional accessory 100 may protect or guard against scratching and scuffing of the external surface of the pitcher 200. Shipping, transportation, and use of the pitcher 200 may be causes for the scratching and scuffing. In an embodiment, the shape of the multi-functional accessory 100 provides protection by covering or enclosing the regions of the pitcher 200 that are prone to scratching and scuffing. Consequently, less packaging material is needed for shipping and transporting the pitcher 200 inserted in the multi-functional accessory 100. Moreover, the multi-functional accessory 100 helps a purchaser to maintain a scratch-free and scuff-free pitcher 200 despite contact made with other items inside or outside of a refrigerator. In an embodiment, the shape of the multi-functional accessory 100 does not cover or enclose the entire external surface of the pitcher 200 but still provides cost-effective protection for the pitcher 200.

Now referring again to the side view of FIG. 4, the bottom surface 410 of the pitcher 200, which is resting inside the cavity 45 (FIG. 1) of the multi-functional accessory 100, contacts and sits on the surface projections 39 of the base 30, in accordance with an embodiment. Accordingly, the bottom surface 410 of the pitcher 200 is raised with respect to a surface (e.g., a table surface) on which the multi-functional accessory 100 stands. Consequently, the surface is free of a footprint or ring caused by dirt or moisture on the bottom surface 410 of the pitcher 200 and by the bottom surface 410 of the pitcher 200 being in direct contact with the surface. In an embodiment, the multi-functional accessory 100 functions as a coaster to maintain the surface clean and free of stains.

Referring again to FIG. 1, in accordance with an embodiment, the multi-functional accessory 100 serves as a platform for implementing modifications to a pitcher 200 (FIG. 2) in a time-saving and less costly manner, whereas the modifications would otherwise be made to the pitcher 200 (FIG. 2) itself. Since implementing a modification to the design of the pitcher 200 (FIG. 2) is time-consuming and costly, the multi-functional accessory 100 offers the ability to modify or differentiate the existing design of the pitcher 200 (FIG. 2) without actually changing the existing design of the pitcher 200 (FIG. 2).

For example, instead of adding a pattern to the pitcher 200 (FIG. 2) because the pattern is absent from the pitcher 200 (FIG. 2), which would be time-consuming and costly to accomplish, the pattern is added to the design of the multi-functional accessory 100, which is then manufactured. Changes to the multi-functional accessory 100 may be accomplished in a shorter time span and at lower costs than changes to the existing design of the pitcher 200 (FIG. 2). Moreover, because the pitcher 200 (FIG. 2) rests inside the cavity 45 (FIG. 1) of the multi-functional accessory 100, there is the impression that the pitcher 200 (FIG. 2) has been changed in some manner even though no change to the pitcher 200 (FIG. 2) has been made. In effect, the multi-functional accessory 100 functions as a platform for customizing the pitcher 200 (FIG. 2).

Consequently, the multi-functional accessory 100 may be utilized to implement a larger number of modifications within a shorter time period, reducing the chance that a modification valued by the purchaser is not implemented.

A variety of modifications may be implemented with the multi-functional accessory 100. In an embodiment, the modifications may be implemented using the wall 40. Surface texture, color (e.g., white, chrome, blue, green, orange, violet, black, red, etc.), text, labels, and lines are additional examples, which may be absent from the pitcher 200 (FIG. 2), of modifications the multi-functional accessory 100 may be utilized to implement. With respect to color, a purchaser may decide to buy the pitcher 200 (FIG. 2) based on the color of the pitcher 200 (FIG. 2) even if the purchaser had not planned to purchase the pitcher 200 (FIG. 2) at all. The multi-functional accessory 100 provides the opportunity to offer more color choices and to create new color combinations between the multi-functional accessory 100 and the pitcher 200 (FIG. 2). In an embodiment, the pitcher 200 may be clear and translucent while the multi-functional accessory 100 offers a platform to add color.

Further, the multi-functional accessory 100 provides new opportunities to create themed pitchers. Christmas-themed, Thanksgiving-themed, Halloween-themed, and Easterthemed are examples of design themes for the multi-functional accessory 100. As a result, a unique pitcher 200 (FIG. 2) with the multi-functional accessory 100 is available for each festive occasion of the year.

Figure 6:
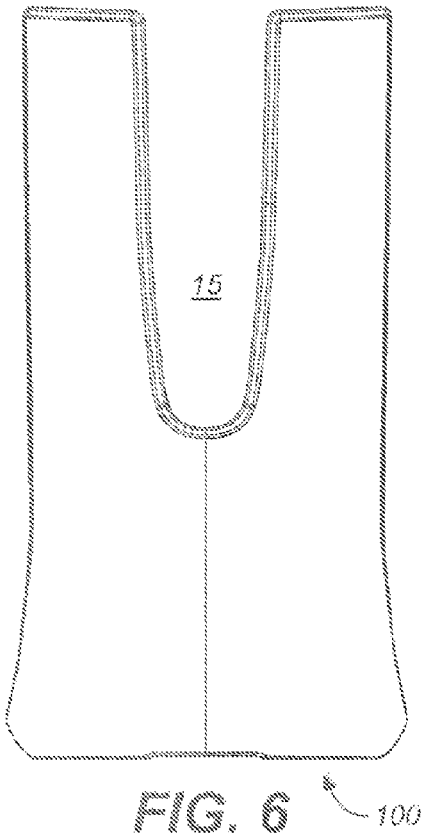
FIG. 6 illustrates a front view of the multi-functional accessory 100 of FIG. 1 in accordance with an embodiment.

FIG. 6 illustrates a front view of the multi-functional accessory 100 of FIG. 1 in accordance with an embodiment. The spout-receiving portion 15 is depicted in FIG. 6.

Figure 7:
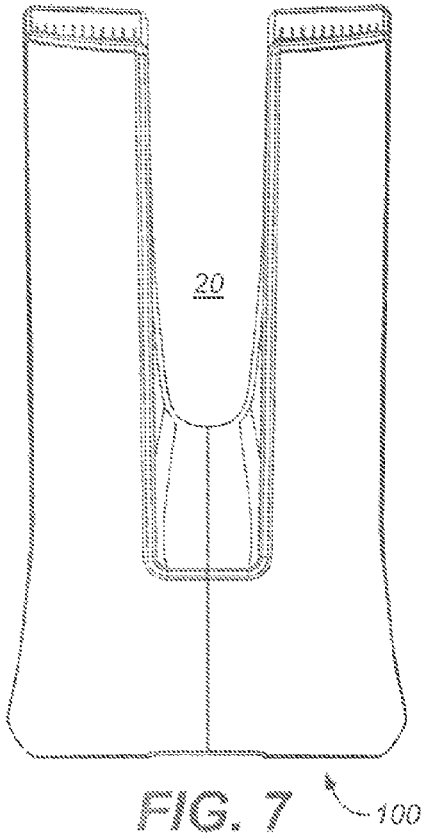
FIG. 7 illustrates a back view of the multi-functional accessory 100 of FIG. 1 in accordance with an embodiment.

FIG. 7 illustrates a back view of the multi-functional accessory 100 of FIG. 1 in accordance with an embodiment. The handle-receiving portion 20 is depicted in FIG. 7.

Figure 8:
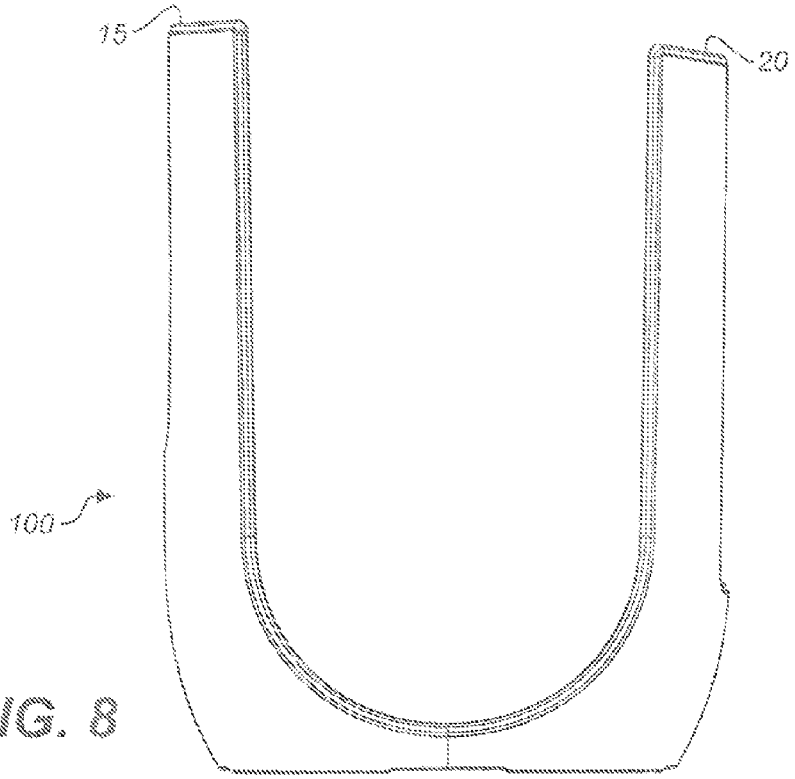
FIG. 8 illustrates a side view of the multi-functional accessory 100 of FIG. 1 in accordance with an embodiment.

FIG. 8 illustrates a side view of the multi-functional accessory 100 of FIG. 1 in accordance with an embodiment. The position of the spout-receiving portion 15 relative to the handle-receiving portion 20 is shown in FIG. 8.

Figure 9:
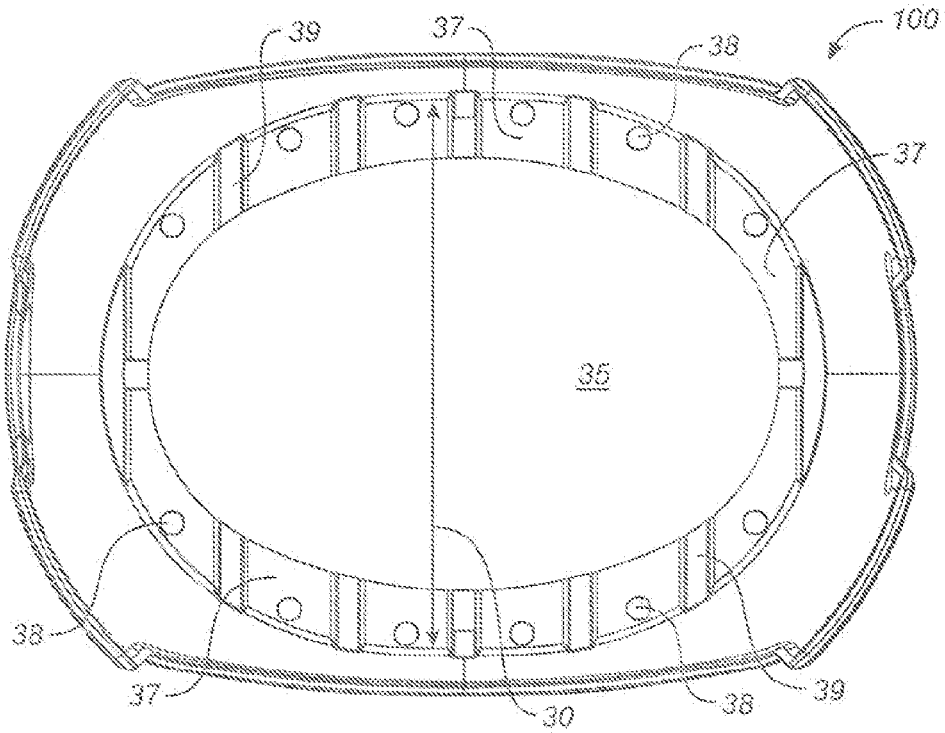
FIG. 9 illustrates a top view of the multi-functional accessory 100 of FIG. 1 in accordance with an embodiment.

Now referring to FIG. 9, a top view of the multi-functional accessory 100 of FIG. 1 is shown, in accordance with an embodiment. FIG. 9 depicts the base 30 of the multi-functional accessory 100 in greater detail in accordance with an embodiment. The opening 35, the channels 37, the holes 38, and the surface projections 39 of the base 30 are shown in FIG. 9.

Figure 10:
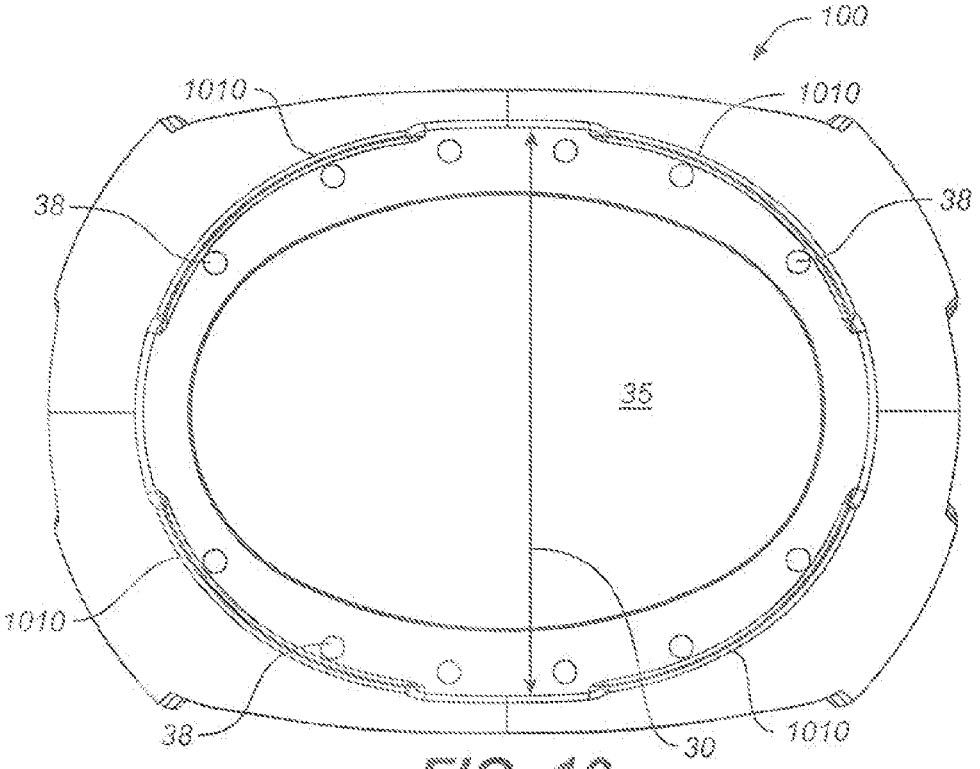
FIG. 10 illustrates a bottom view of the multi-functional accessory 100 of FIG. 1 in accordance with an embodiment.

Further, FIG. 10 illustrates a bottom view of the multi-functional accessory 100 of FIG. 1 in accordance with an embodiment. In particular, FIG. 10 shows a bottom of the base 30 of the multi-functional accessory 100 in greater detail in accordance with an embodiment. The opening 35 and the holes 38 of the base 30 are depicted in FIG. 10. Moreover, the bottom of the base 30 includes a plurality of feet 1010 that support and balance the multi-functional accessory 100 on a surface (e.g., a table surface).

The foregoing descriptions of specific embodiments have been presented for purposes of illustration and description. They are not intended to be exhaustive or to limit the disclosure to the precise forms disclosed, and many modifications and variations are possible in light of the above teaching. The embodiments were chosen and described in order to best explain the principles of the disclosure and its practical application, to thereby enable others skilled in the art to best utilize the disclosure and various embodiments with various modifications as are suited to the particular use contemplated. It is intended that the scope of the disclosure be defined by the Claims appended hereto and their equivalents.

What is claimed is:

1. An accessory comprising:
a base; and
a wall defining a cavity, wherein the cavity is operable to receive a product therein, wherein the cavity includes:
an internal surface,
an external surface, and
a single, continuous and rigid lip on the internal surface operable for maintaining contact with upper, middle and lower portions of a product received about a perimeter of the cavity thereby spacing the product from the internal surface such that the wall forms a sleeve to protect against scratching and scuffing of the product during shipping, transport and use.

2. The accessory of claim 1, wherein the base comprises:
an opening;
a plurality of channels; and
a plurality of surface projections.

3. The accessory of claim 2, wherein the base further comprises:
a plurality of holes spaced apart and located in the channels.

4. The accessory of claim 1, wherein the wall is operable to be modified to add a modification that is absent from the product.

5. The accessory of claim 1, wherein the lip is operable to create a fixed gap between an external surface of the product and the internal surface.

6. The accessory of claim 5, further comprising:
a passage operable to drain a liquid, wherein the passage includes:
the fixed gap,
at least one of the channels, and
the opening.

7. An accessory comprising:
a wall defining a cavity, wherein the cavity is operable to receive a pitcher therein, wherein the cavity includes:
an internal surface,
an external surface, and
a single, continuous and rigid lip that extends along a perimeter of the internal surface operable for maintaining contact with upper, middle and lower portions of the pitcher when received with the cavity thereby spacing the pitcher from the internal surface such that the wall forms a sleeve to protect against scratching and scuffing of the pitcher during shipping, transport and use;
a base;
a spout-receiving portion operable to receive a spout of the pitcher; and
a handle-receiving portion operable to receive a handle of the pitcher.

8. The accessory of claim 7, wherein the base comprises:
an opening;
a plurality of channels; and
a plurality of surface projections.

9. The accessory of claim 8, wherein the base further comprises:
a plurality of holes spaced apart and located in the channels.

10. The accessory of claim 7, wherein the wall is operable to be modified to add a modification that is absent from the pitcher.

11. The accessory of claim 7, wherein the lip is operable to create a fixed gap between an external surface of the pitcher and the internal surface.

12. The accessory of claim 11, further comprising:
a passage operable to drain a liquid, wherein the passage includes:
the fixed gap,
at least one of the channels, and
the opening.

13. An apparatus comprising:
a pitcher; and
an accessory including:
a base; and
a wall defining a cavity, wherein the cavity is operable to receive the pitcher therein, wherein the cavity includes:
an internal surface,
an external surface, and
a single, continuous and rigid lip that extends along a perimeter of the internal surface operable for maintaining contact with upper, middle and lower portions of the pitcher when received with the cavity thereby spacing the pitcher from the internal surface such that the wall forms a sleeve to protect against scratching and scuffing of the pitcher when the pitcher contacts the base.

14. The apparatus of claim 13, wherein the base comprises:
an opening;
a plurality of channels; and
a plurality of surface projections.

15. The apparatus of claim 14, wherein the base further comprises:
a plurality of holes spaced apart and located in the channels.

16. The apparatus of claim 13, wherein the wall is operable to be modified to add a modification that is absent from the pitcher.

17. The apparatus of claim 13, wherein the lip is operable to create a fixed gap between an external surface of the pitcher and the internal surface, and further comprising:
a passage operable to drain a liquid, wherein the passage includes:
the fixed gap,
at least one of the channels, and
the opening.

18. The accessory of claim 1, wherein the accessory is irremovably attached to the product by ultrasonic welding of the lip to the product.

19. The accessory of claim 7, wherein the accessory is irremovably attached to the pitcher by ultrasonic welding of the lip to the pitcher.

20. The apparatus of claim 13, wherein the accessory is irremovably attached to the pitcher by ultrasonic welding of the lip to the pitcher.

* * * * *